US005535774A

United States Patent [19]

Davies

[11] Patent Number: 5,535,774

[45] Date of Patent: Jul. 16, 1996

[54] APPARATUS FOR STORING AND SUPPLYING WATER FOR USE IN CATERING EQUIPMENT

[75] Inventor: Gary Davies, Brnstaple, England

[73] Assignee: Premark FEG Corporation, Wilmington, Del.

[21] Appl. No.: 382,872

[22] Filed: Feb. 3, 1995

[30] Foreign Application Priority Data

Feb. 8, 1994 [GB] United Kingdom ..... 9402412

[51] Int. Cl.[6] ..... E03C 1/10

[52] U.S. Cl. ..... 137/216; 134/105; 137/341; 137/403

[58] Field of Search ..... 137/216, 341, 137/403; 134/105, 107

[56] References Cited

U.S. PATENT DOCUMENTS 3,381,700 5/1968 Frymark ..... 137/216
4,354,094 10/1982 Massey et al. ..... 219/306
5,039,405 8/1991 Cattani ..... 137/215

FOREIGN PATENT DOCUMENTS 1360673 7/1974 United Kingdom .
1371466 10/1974 United Kingdom .

*Primary Examiner*—Gerald A. Michalsky
*Attorney, Agent, or Firm*—Thompson Hine & Flory

[57] ABSTRACT

Apparatus is disclosed for storing and supplying water for use in a unit of catering equipment, comprising means for controlling the supply of water from a mains source to a water storage tank and means adapted to supply a predetermined volume of water from the storage tank for use in the catering equipment unit, the control means being adapted to supply water so as to maintain the quantity of water within the storage tank substantially constant wherein the volume of the storage tank is equal to, or not less than, the predetermined volume so that the storage tank may be of sufficiently small dimensions as to be located within the housing the catering equipment unit, an air gap of predetermined dimensions being provided between the mains source and the storage tank.

9 Claims, 2 Drawing Sheets

APPARATUS FOR STORING AND SUPPLYING WATER FOR USE IN CATERING EQUIPMENT

BACKGROUND OF THE INVENTION

This invention relates to apparatus for storing and supplying water for use in a unit of catering equipment, such as a dishwasher.

In such equipment, a storage tank is often provided to hold a quantity of water supplied from a mains source so that, when the catering equipment requires water, this is supplied from the storage tank rather than directly from the mains source. In order reliably to supply the required amount of water, the storage tank has heretofore been designed to contain substantially more water than is required by the catering equipment at any time; this has meant that such storage tanks are large and either they must be mounted outside the housing of the unit or the size of the housing has to be increased in order that the storage tank may fit within the housing. In either case this leads to an increase in the overall size of the unit.

Furthermore, the storage tank is often used to contain hot water, and to keep the water at the correct temperature the tank must be insulated and/or means provided to heat the water so as to maintain it at the correct temperature. The larger the storage tank, therefore, the greater the amount of insulation material required and the more energy consumed in order to maintain the water within the storage tank at the correct temperature.

A desirable requirement of such storage tanks is that, in the event of a sudden drop in pressure in the mains water supply feeding the water storage tank, water from the storage tank is prevented from being drawn back into the mains supply, potentially contaminating the mains water supply with dirty water from the storage tank.

SUMMARY OF THE INVENTION

In accordance with the invention, apparatus for storing and supplying water for use in a unit of catering equipment (e.g. a dishwasher) comprises means for controlling the supply of water from a mains source to a water storage tank and means adapted to supply a predetermined volume of water from the storage tank for use in the catering equipment unit, the control means being adapted to supply water so as to maintain the quantity of water within the storage tank substantially constant, wherein the volume of the storage tank is equal to, or not less than, the predetermined volume so that the storage tank may be of sufficiently small dimensions as to be located within the housing of the unit of catering equipment, an air gap of predetermined dimensions being provided between the mains supply and the storage tank.

With such an arrangement the storage tank may be configured so as to fit within the existing housing of the unit of catering equipment and thereby reduce the amount of floor space required for the unit of catering equipment.

Where such a storage tank is to be used to contain hot water, less insulation material and/or a smaller heater element which uses less energy is required to maintain the water at the correct temperature than in conventional storage tanks. Because the storage tank may be made much smaller than heretofore, it is possible to supply cold water to the storage tank and to heat it to the correct temperature within the storage tank immediately prior to use. Such an arrangement may be more energy efficient than conventional storage tanks which are supplied from a hot water mains supply.

The storage tank may be formed in two parts, a main tank portion connected to an inlet portion. With such an arrangement the main portion may be located towards the bottom of the unit of catering equipment with the inlet portion extending up towards the top of the unit of catering equipment so that the upper level of the water within the inlet portion of the storage tank is above the level at which the water is used within the unit of catering equipment. In this way hydraulic pressure acts to assist the supply of water from the storage tank to the unit of catering equipment so that less energy is required to pump water from the storage tank when water is required.

Conveniently a pressure sensor, or switch, may be provided within the main part of the storage tank to sense the hydraulic pressure therein and to actuate the control means to supply more water to the storage tank so as to maintain substantially constant the quantity of water within the storage tank.

One more problem associated with known water storage tanks concerns the provision of an overflow discharge outlet. In the event the capacity of the storage tank is exceeded, by inadvertently supplying too much water from the mains supply, or due to water flowing from the catering equipment back into the storage tank, for example, then the excess water must be allowed to discharge from the water storage tank. Often this is accomplished by allowing the excess water to overflow from the storage tank onto the floor or by directing the excess water to discharge directly into the catering equipment. The former is both unhygienic and also presents the possibility that an operator might slip or be scalded and the latter risks contaminating the contents of the catering equipment; furthermore, steam and/or odours may escape from the storage tank and contaminate the contents of the catering equipment and/or the surroundings.

To answer this problem an overflow discharge outlet may be provided adjacent the upper portion of the inlet portion of the storage tank to permit excess water to flow directly into the unit of catering equipment. Suitably a water trap in the form of a 'U'-tube may be incorporated in the overflow discharge outlet so as to prevent any contaminating steam and/or odour from escaping from the storage tank.

The inlet portion of the storage tank, or the whole of the storage tank, may be formed of a suitable plastics material.

BRIEF DESCRIPTION OF THE DRAWINGS

The invention will now be described by way of example and with reference to the accompanying drawings, in which.

DETAILED DESCRIPTION

Figure 1:
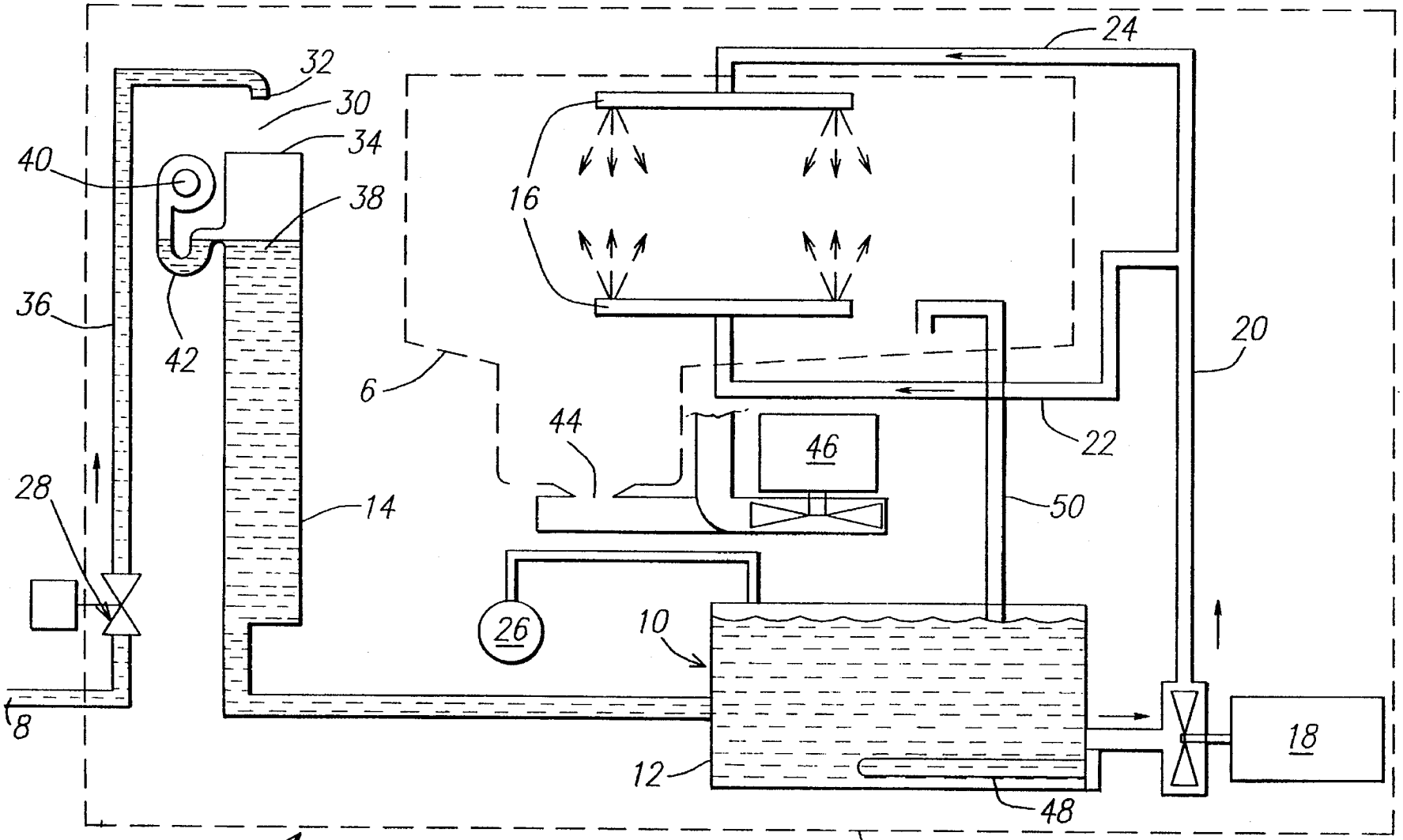
FIG. 1 is a schematic diagram of a dishwasher in accordance with the invention.

Referring to FIG. 1, a dishwasher generally shown at 2 in accordance with the invention comprises an outer housing 4 and an inner housing, or wash tank, 6 within which dishes (not shown) are washed. Water from a mains supply 8 is supplied to a water storage tank 10 within the housing 4 of the dishwasher 2 as described below.

The storage tank 10 consists of an inlet portion 14 and a larger main portion 12. Water is conveyed from the main portion 12 of the storage tank 10 to a number of rinse arms 16 by means of a booster pump 18 along pipes 20, 22, 24 in the direction of the arrows. The water is discharged from the rinse arms 16 in the directions shown generally by the arrows so as to rinse the dishes (not shown) within the inner housing, or wash tank, 6 of the dishwasher 2.

A sensor 26 measures the pressure of the water within the main portion 12 of the storage tank 10, which pressure corresponds to the level of the water within the inlet portion 14 of the storage tank 12 and hence the amount of water within the storage tank 12, and, via suitable control circuitry (not shown) actuates inlet valve 28 so as to permit water from the mains supply 8 to enter the dishwasher 2 and the storage tank 12 thereof via pipe 36.

The inlet portion 14 of the storage tank 10 is in the form of a thin column (see FIG. 3) so that it may extend down the inside of the panelling, or housing, 4 of the dishwasher 2, and the main portion 12 is located towards the bottom of the dishwasher 2.

An air gap 30 of predetermined dimensions is provided between the outlet 32 of pipe 36 and the inlet 34 of inlet portion 14 of the storage tank 12. This air gap prevents any possibility of water from the storage tank 12 flowing back into the mains supply 8.

To prevent water within the inlet portion 14 of the storage tank 10 overflowing over the top 34 thereof, an overflow discharge outlet 40 is provided. The overflow discharge outlet 40 communicates with the inner housing 6 of the dishwasher by a suitable pipe (not shown) so that any excess water in the storage tank 12 is discharged via the dishwasher inner housing 6. In the event that the upper surface 38 of the water within the inlet portion 14 of the storage tank 12 rises towards the inlet 34 to the storage tank 12, the excess water will overflow through the overflow discharge outlet 40 before the upper surface 38 of the water reaches the inlet 34 to the storage tank 12 and overflows into the housing 2 of the dishwasher and/or onto the floor. A water trap, or 'U'-tube, 42, is provided to prevent the escape of any steam or odour from the storage tank 12 via the overflow discharge tube 40. A suitable arrangement of baffles (not shown) may be provided to surround the air gap 30, or the housing 4 of the dishwasher 2 may be sealed, so as to prevent steam and/or odour escaping from the inlet 34 into the atmosphere.

Water is drawn from the wash chamber 6 via an outlet 44 by a wash motor 46 which circulates water for washing the dishes within the wash chamber 6. A heating element 48 is provided within the main part 12 of the water storage tank 10 so as to heat the water 2, or to maintain the water at the required temperature. A thermostat (not shown) is provided and linked, via appropriate control circuitry (not shown), to actuate the heating element 48. The control circuitry (not shown) may comprise an appropriately programmed microprocessor to control the wash, rinse, drain cycle of the dishwasher 2 timing the operation of the pump 18 and the washer motor 46, and maintaining the temperature of the water within the main portion 12 of the storage tank 10 at the correct level, as well as controlling the inlet valve 28 to maintain a substantially constant amount of water within the storage tank 10.

A vent 50 is provided to vent excess pressure from the main portion of the storage tank 10 into the wash chamber 6.

Figure 2:
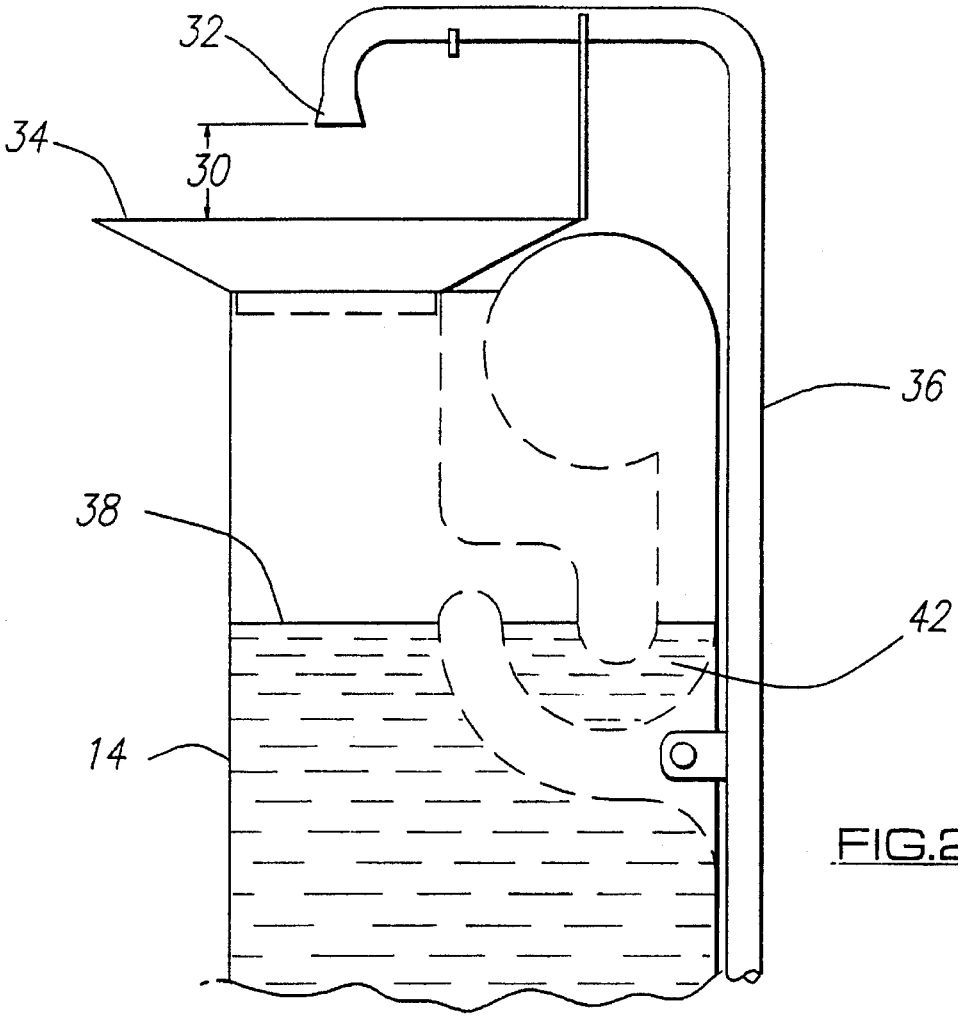
FIG. 2 is an enlarged view of the upper part of the inlet portion of the storage of FIG. 1.
Figure 3:
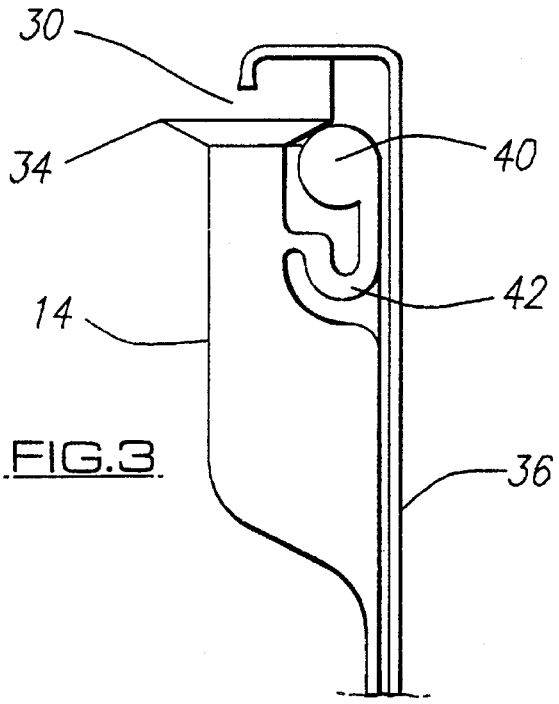
FIG. 3 is an enlarged view of the inlet portion of the storage tank of FIG. 1.

Referring now to FIGS. 2 and 3, FIG. 2 is an enlarged view of the upper part of the inlet portion 14 of the storage tank of FIG. 1 showing the air gap 30. The size of the air gap 30 is chosen so as to eliminate any chance of water flowing into the mains supply 8 from the storage tank 12 via the pipe 36, and is suitably about three times the diameter of the supply pipe 36. The outlet end 32 of supply pipe 36 is pressed or flared into an oval shape and the inlet 34 to the storage tank 12 is funnel shaped to prevent water discharged from the outlet 32 of the supply pipe 36 from splashing and leaking into the housing 4 of the dishwasher 2 and also so as to minimise the width (into the flue of FIGS. 2 and 3) of the inlet portion 14.

The inlet portion 14 of the storage tank 10 and the supply pipe 36 may be injection moulded from a suitable plastics material. The main portion 12 of the storage tank is made separately. However, it could be integrally moulded with the inlet portion 14.

The present invention has been described with reference to a dishwasher. However, the present invention is applicable to any unit of catering equipment which requires a water supply such as a boiler or beverage dispenser, for example, and also to other units of equipment, for example a washing machine.

I claim:

1. Apparatus for storing and supplying water for use in a unit of catering equipment, comprising:

a housing for the catering equipment unit;

a water storage tank within the housing;

means for controlling the supply of water from a main source to the water storage tank;

an air gap of predetermined dimensions being provided between the main source and the storage tank; and means adapted to supply a predetermined volume of water from the storage tank for use in the catering equipment unit, the control means being adapted to supply water so as to maintain the quantity of water within the storage tank substantially constant, wherein the volume of the storage tank is not less than the predetermined volume, so that the storage tank is of sufficiently small dimension as to be located within the housing of the catering equipment unit.

2. Apparatus as claimed in claim 1 wherein means are provided to heat water in the storage tank.

3. Apparatus for storing and supplying water for use in a unit of catering equipment, comprising:

a housing for the catering equipment unit;

a water storage tank within the housing, wherein the storage tank is formed in two parts, a main tank portion connected to an upper inlet portion;

means for controlling the supply of water from a main source to the water storage tank;

an air gap of predetermined dimensions being provided between the main source and the storage tank; and means adapted to supply a predetermined volume of water from the storage tank for use in the catering equipment unit, the control means being adapted to supply water so as to maintain the quantity of water within the storage tank substantially constant, wherein the volume of the storage tank is not less than the predetermined volume, so that the storage tank is of sufficiently small dimension as to be located within the housing of the catering equipment unit.

4. Apparatus as claimed in claim 3 wherein the inlet portion is disposed above the main tank portion.

5. Apparatus as claimed in claim 4 comprising means to sense the pressure of the water within the main tank portion, the control means being adapted to supply water in response to the sensed pressure so as to maintain substantially constant the quantity of water within the storage tank.

6. Apparatus as claimed in claim 3 comprising an overflow discharge outlet adjacent upper portion of the inlet portion of the storage tank.

7. Apparatus as claimed in claim 6 wherein the overflow discharge outlet is connected to the unit of catering equipment so as to allow excess water in the storage tank to flow into the catering equipment unit.

8. Apparatus as claimed in claim 6 wherein a water trap in the form of a 'U'-tube is incorporated in the overflow discharge outlet.

9. Apparatus as claimed in claim 3 wherein at least the inlet portion of the storage tank is formed of a plastics material.

* * * * *

UNITED STATES PATENT AND TRADEMARK OFFICE

CERTIFICATE OF CORRECTION

PATENT NO. : 5,535,774

DATED : July 16, 1996

INVENTOR(S) : Gary Davies

It is certified that error appears in the above-indentified patent and that said Letters Patent is hereby corrected as shown below:

In Column 5, claim 6, line 7, before "upper" add --an--.

Signed and Sealed this

Seventeenth Day of September, 1996

Bruce Lehman

*Attest:*

BRUCE LEHMAN

*Attesting Officer*

*Commissioner of Patents and Trademarks*